US008305002B2

(12) United States Patent
Louvel

(10) Patent No.: US 8,305,002 B2
(45) Date of Patent: Nov. 6, 2012

(54) METHOD AND STRUCTURE OF FORMING A FLUORESCENT LIGHTING SYSTEM

(75) Inventor: Jean-Paul Louvel, Colomiers (FR)

(73) Assignee: Semiconductor Components Industries, LLC, Phoenix, AZ (US)

( * ) Notice: Subject to any disclaimer, the term of this patent is extended or adjusted under 35 U.S.C. 154(b) by 275 days.

(21) Appl. No.: 12/739,527

(22) PCT Filed: Nov. 26, 2007

(86) PCT No.: PCT/US2007/085508

§ 371 (c)(1), (2), (4) Date: Apr. 23, 2010

(87) PCT Pub. No.: WO2009/070153

PCT Pub. Date: Jun. 4, 2009

(65) Prior Publication Data

US 2010/0259189 A1 Oct. 14, 2010

(51) Int. Cl.
*H05B 37/00* (2006.01)

(52) U.S. Cl. ..... 315/229; 315/231; 315/324

(58) Field of Classification Search ..... 315/228, 315/229, 231, 239, 312, 324
See application file for complete search history.

(56) References Cited

U.S. PATENT DOCUMENTS

| | | | | |
|---|---|---|---|---|
| 6,781,325 | B2 | 8/2004 | Lee | |
| 7,042,171 | B1 * | 5/2006 | Lin | 315/291 |
| 7,205,724 | B2 | 4/2007 | Ahn et al. | |
| 7,733,031 | B2 * | 6/2010 | Nerone | 315/224 |
| 2006/0001386 | A1 * | 1/2006 | Kim et al. | 315/312 |

* cited by examiner

*Primary Examiner* — Thuy Vinh Tran
(74) *Attorney, Agent, or Firm* — Robert F. Hightower

(57) ABSTRACT

A lighting system comprising a first plurality of fluorescent lamps (17) constituted by a first and a second lamp (20, 21) having a first common terminal (18) which is connected via a first capacitor (22) to a first terminal (12) of a voltage source (11). The system further comprises a second plurality of fluorescent lamps (29) constituted by a third and a fourth lamp (32, 33) having a first common terminal (30) which is connected via a second capacitor (34) to the first terminal (12) of a voltage source (11). The second terminals of the first lamp (20) and third lamp (32) are connected to a first terminal (24) of a third capacitor (25), said third capacitor (25) being connected with its second terminal to the second terminal (13) of the voltage source (11). The second terminals of the second lamp (21) and fourth lamp (33) are connected to a first terminal (36) of a fourth capacitor (37), the fourth capacitor (37) being connected with its second terminal to the second terminal (13) of the voltage source (11).

14 Claims, 1 Drawing Sheet

METHOD AND STRUCTURE OF FORMING A FLUORESCENT LIGHTING SYSTEM

This application is a national stage application of international application no. PCT/US2007/085508 filed on Nov. 26, 2007 and priority thereto is hereby claimed.

BACKGROUND OF THE INVENTION

The present invention relates, in general, to electronics, and more particularly, to methods of forming semiconductor devices and structure.

In the past, various different configurations were used to produce fluorescent lighting systems. Some of the configurations used transformers or multiple transformers to form a voltage for initially exciting and for operating for the fluorescent lights of the fluorescent lighting system. Some configurations also utilized two capacitors for each florescent light within the fluorescent lighting system. One example of such a fluorescent lighting system was disclosed in U.S. Pat. No. 7,205,724 that issued on Apr. 17, 2007 to Ahn et al. The large number of capacitors increased the cost of the fluorescent lighting system.

Accordingly, it is desirable to have a fluorescent lighting system that has a lower cost.

BRIEF DESCRIPTION OF THE DRAWINGS

For simplicity and clarity of the illustration, elements in the figures are not necessarily to scale, and the same reference numbers in different figures denote the same elements. Additionally, descriptions and details of well-known steps and elements are omitted for simplicity of the description.

DETAILED DESCRIPTION OF THE DRAWINGS

Figure 1:
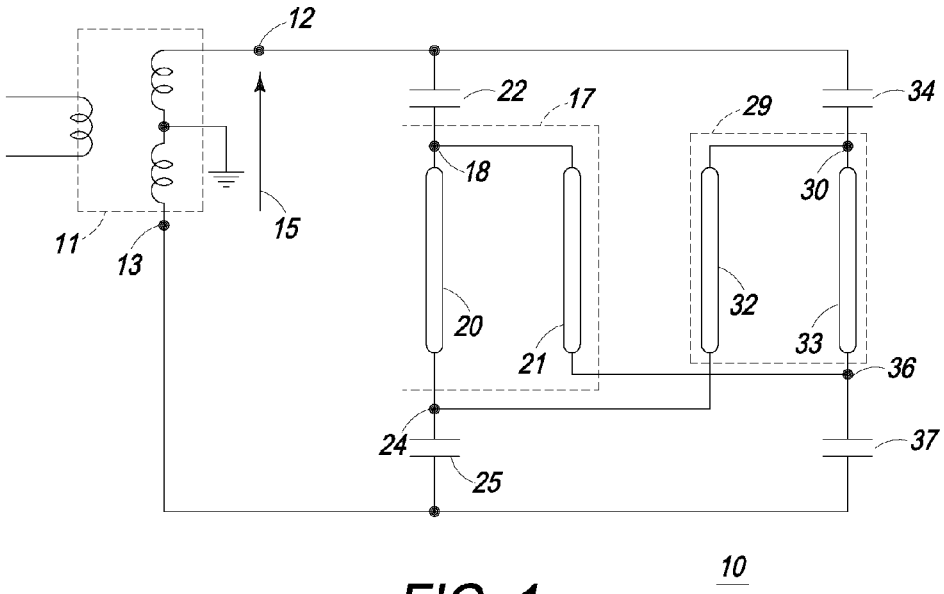
FIG. 1 schematically illustrates a portion of an embodiment of a fluorescent lighting system in accordance with the present invention.

FIG. 1 schematically illustrates a portion of an embodiment of a fluorescent lighting system 10 that includes a first plurality of fluorescent lights 17 and a second plurality of fluorescent lights 29. System 10 receives power from a voltage source, such as a transformer 11. Transformer 11 may receive power from a variety of sources that are well known to those skilled in the art. For example, the primary side of transformer 11 may receive power from an alternating cycle (AC) voltage source, or from a PWM controller that drives the primary side of transformer 11. The secondary of transformer 11 functions as a voltage source 15, illustrated in general by an arrow, that forms a voltage for operating system 10. System 10 receives the voltage from source 15 between a first terminal 12 and a second terminal 13 of transformer 11.

First plurality of fluorescent lights 17 includes a first fluorescent light 20 and a second fluorescent light 21, and second plurality of fluorescent lights 29 includes a first fluorescent light 32 and a second fluorescent light 33. Lights 20 and 21 are connected to receive the voltage from voltage source 15 through a capacitor 22 that is connected between source 15 and a common node 18 of lights 20 and 21. A first terminal of each of lights 20 and 21 is commonly connected to common node 18. A first terminal of capacitor 22 is connected to node 18 and a second terminal is connected to terminal 12. A second terminal of light 20 is connected to voltage source 15 through a capacitor 25. The second terminal of light 20 is connected to a common node 24 and to a first terminal of capacitor 25. A second terminal of capacitor 25 is connected to terminal 13. A second terminal of light 21 is connected to voltage source 15 through another capacitor 37. The second terminal of light 21 is connected to a common node 36 and to a first terminal of capacitor 37. A second terminal of capacitor 37 is connected terminal 13. Similarly, a first terminal of lights 32 and 33 is commonly connected to a common node 30 of second plurality of lights 29. Lights 32 and 33 are connected to receive the voltage from voltage source 15 through a capacitor 34 that has a first terminal connected to common node 30 and a second terminal connected to terminal 12. A second terminal of light 32 is connected to voltage source 15 through capacitor 25 and a second terminal of light 33 is connected to voltage source 15 through capacitor 37. The second terminal of light 32 is connected to common node 24 and the second terminal of light 33 is connected to common node 36.

When transformer 11 begins to form a voltage for voltage source 15, capacitors 22, 25, 34, and 37 are discharged. The entire voltage between terminals 12 and 13 is applied across lights 20, 21, 32, and 33. As the lights become excited, current flows through capacitors and charges the capacitors. For example, as light 20 becomes active, current flows through capacitor 22, light 20, and capacitor 25 and through light 20. The current charges capacitors 22 and 25 to the voltage of source 15. Assuming the capacitors have substantially equal values, one-half of the voltage from source 15 is dropped across capacitor 22 and one-half is dropped across capacitor 25. Similarly, when light 21 becomes excited, current flows from source 15 through capacitor 22, through light 21, and through capacitor 37. Thus, one-half of the voltage from source 15 is dropped across capacitor 22 and another half is dropped across capacitor 37. When light 32 becomes excited, current flows through capacitor 34, through light 32, and through capacitor 25. After the voltage has activated light 32, the voltage from source 15 is dropped substantially equally across capacitors 34 and 25. After the voltage is large enough to activate light 33, current flows through capacitor 34, light 33, and capacitor 37 thereby charging capacitors 34 and 37 to approximately one-half of the voltage of source 15. As will be appreciated by those skilled in the art, some lights may become excited before others, therefore, the voltage from source 15 has to be large enough to ensure that all of lights 20, 21, 32, and 33 are activated.

Figure 2:
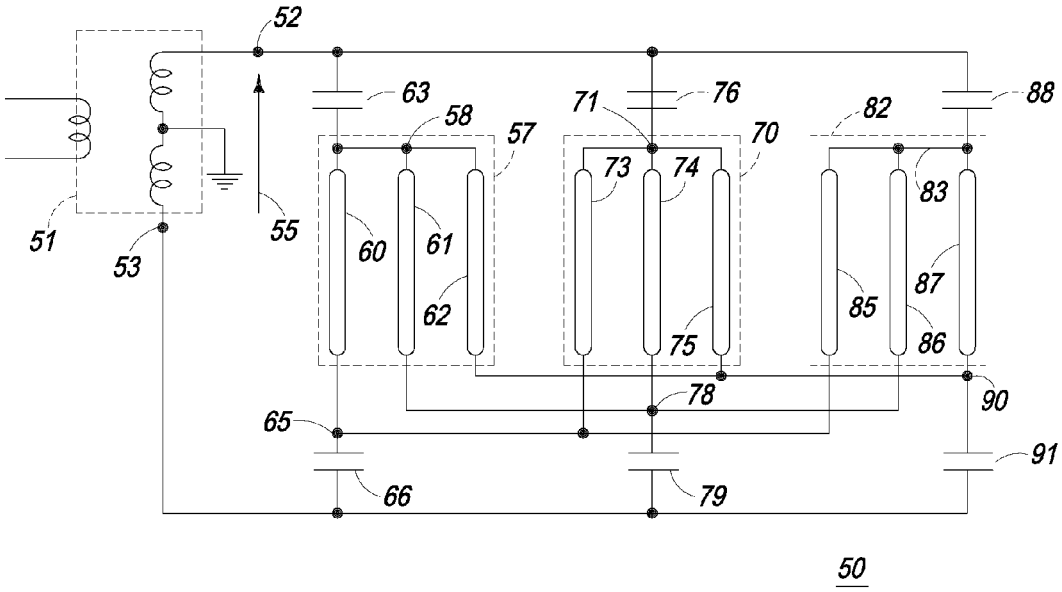
FIG. 2 schematically illustrates another embodiment of a portion of a fluorescent lighting system in accordance with the present invention.

FIG. 2 schematically illustrates a portion of an embodiment of a light system 50 that includes a greater number of fluorescent lights. System 50 is similar to system 10 except that system 50 has more fluorescent lights connected to each common node. Typically, the number of fluorescent lights connected to each common node is substantially equal to the number of common nodes on each side of the lights. For example and referring to FIG. 1, there are two common nodes, nodes 18 and 30, on one side of lights 20, 21, 32, and 33 and two common nodes, nodes 24 and 36, connected to the other side of lights 20, 21, 32, and 33. Because there are two common nodes on each side of the fluorescent lights, there are two fluorescent lights connected to each common node. Referring back to FIG. 2, there are three common nodes connected to each side of the fluorescent lights, thus, there are three fluorescent lights connected to each common node. System 50 includes a transformer 51 that is similar to transformer 11 except that the value of a voltage source 55 formed by transformer 51 generally is greater than the value of voltage source 15 because there are more lights that have to be excited by system 50. Transformer 51 has terminals 52 and 53 across which the voltage of voltage source 55 is formed similar to terminals 12 and 13 of transformer 11. System 50 includes a first plurality of fluorescent lights 57 that includes fluorescent lights 60, 61, and 62, a second plurality of fluorescent lights 70 includes fluorescent lights 73, 74, and 75, and a third plurality of fluorescent lights 82 includes fluorescent lights 85, 86, and 87. Each of lights 60, 61, and 62 have a first terminal of that is connected to a common node 58 and to a first terminal of a capacitor 63. A second terminal of capacitor 63 is connected terminal 52. The second terminal of each of lights 60, 61, and 62 are each connected to a different capacitor. The second terminal of light 60 is connected to a common node 65 in order receive voltage from source 55 through a capacitor 66. The first terminal of capacitor 66 is connected to node 65 and a second terminal of capacitor 66 is connected to terminal 53. The second terminal of light 61 is connected to a common node 78 in order to receive voltage from source 55 through a capacitor 79. A first terminal of capacitor 79 is connected to node 78 and a second terminal of capacitor 79 is connected to terminal 53. The second terminal of light 62 is connected to a common node 90 in order to receive voltage from voltage source 55 through a capacitor 91. The first terminal of capacitor 91 is connected to node 90 and second terminal of capacitor 91 is connected to terminal 53. Similarly, lights 73, 74, and 75 have a first terminal connected to a first terminal of a capacitor 76 which has a second terminal connected to terminal 52. A second terminal of each of lights 73, 74, and 75 are connected to respective nodes 65, 78, and 90. Lights 85, 86, and 87 have a first terminal that is commonly connected to a common node 83 and to a first terminal of a capacitor 88. A second terminal of capacitor 88 is connected to terminal 52. A second terminal of lights 85, 86, and 87 are also connected to respective nodes 65, 78, and 90.

Operationally, system 50 functions similarly to system 10. As the voltage from source 55 reaches a value that is sufficient to activate one of the lights, such as light 60, current begins to flow through capacitor 63, light 60, and capacitor 66 and the current charges each of capacitors 63 and 66 to approximately one-half the value of source 55. Similarly, as the voltage of source 55 excites light 61, current flows through capacitor 63, light 61, and capacitor 79 and the current charges each of capacitors 63 and 79 to approximately one-half the voltage of source 55. Exciting light 62 causes current to flow through capacitors 63 and 91 thereby charging each of capacitors 63 and 91 to approximately one-half the voltage of source 55. In a similar manner, activating light 73 charges capacitors 76 and 66, activating light 74 charges capacitors 76 and 79, and activating light 75 charges capacitors 76 and 91. Also, activating light 85 charges capacitors 88 and 66, activating light 86 charges capacitors 88 and 79, and activating light 87 charges capacitors 88 and 91.

In view of all of the above, it is evident that a novel device and method is disclosed. Included, among other features, is configuring the fluorescent lighting system to connect a plurality of fluorescent lights to a common node that is connected to receive a voltage from a voltage source through a capacitor. Connecting a plurality of lights to a common capacitor reduces the number of capacitors required to operate the fluorescent light system. As illustrated in FIG. 2, four capacitors are used for four lights which is approximately one-half of the capacitors used by the prior art. The configuration illustrated in FIG. 2 uses six capacitors which is much less than the eighteen capacitors required by prior configurations.

While the subject matter of the invention is described with specific preferred embodiments, it is evident that many alternatives and variations will be apparent to those skilled in the semiconductor arts.

The invention claimed is:

1. A fluorescent lighting system comprising:

a voltage source having first and second terminals;

a first plurality of fluorescent lights having a first common terminal, the first plurality of fluorescent lights including a first fluorescent light having a first terminal coupled to the first common terminal and having a second terminal and also including a second fluorescent light having a first terminal coupled to the first common terminal and having a second terminal;

a first capacitor coupled between the first common terminal and the first terminal of the voltage source;

a second plurality of fluorescent lights having a second common terminal, the second plurality of fluorescent lights including a third fluorescent light having a first terminal coupled to the second common terminal and having a second terminal and also including a fourth fluorescent light having a first terminal coupled to the second common terminal and having a second terminal wherein the second terminal of the first and third fluorescent lights are commonly connected to a first node and wherein the second terminal of the second and fourth fluorescent lights are commonly connected to a second node;

a second capacitor coupled between the second common terminal and the first terminal of the voltage source;

a third capacitor coupled between the first node and the second terminal of the voltage source; and a fourth capacitor coupled between the second node and the second terminal of the voltage source.

2. The fluorescent lighting system of claim 1 wherein a first terminal of the third capacitor is coupled to the first node and the second terminal of the third capacitor is coupled to the second terminal of the voltage source.

3. The fluorescent lighting system of claim 1 wherein a first terminal of the fourth capacitor is coupled to the second node and the second terminal of the fourth capacitor is coupled to the second terminal of the voltage source.

4. The fluorescent lighting system of claim 1 wherein the first terminal of the first fluorescent light and the first terminal of the second fluorescent light are coupled to a first terminal of the first capacitor and a second terminal of the first capacitor is coupled to the first terminal of the voltage source.

5. The fluorescent lighting system of claim 1 wherein the first terminal of the third fluorescent light and the first terminal of the fourth fluorescent light are coupled to the second common terminal and to a first terminal of the second capacitor.

6. The fluorescent lighting system of claim 5 wherein a second terminal of the second capacitor is coupled to the first terminal of the voltage source.

7. The fluorescent lighting system of claim 1 wherein the first plurality of fluorescent lights includes a fifth fluorescent light having first and second terminals wherein the first terminal is coupled to the first common terminal;

the second plurality of fluorescent lights includes a sixth fluorescent light having first and second terminals wherein the first terminal is coupled to the second common terminal; and further including a third plurality of fluorescent lights having a third common terminal, the third plurality of fluorescent lights including a seventh fluorescent light having first and second terminals, an eight fluorescent light having first and second terminals, and a ninth fluorescent light having first and second terminals wherein the first terminal of the seventh, eight, and ninth fluorescent lights are coupled to the third common terminal and wherein the second terminal of the fifth, sixth, and ninth fluorescent lights are commonly connected to a third node and the third node is capacitively coupled to the voltage source.

8. A fluorescent lighting system comprising:

a voltage source;

a first plurality of fluorescent lights wherein each fluorescent light of the first plurality of fluorescent lights has a first terminal commonly connected to a first common node, the first common node capacitively coupled to the voltage source and wherein each fluorescent light of the first plurality of fluorescent lights has a second terminal;

a second plurality of fluorescent lights wherein each fluorescent light of the second plurality of fluorescent lights has a first terminal commonly connected to a second common node, the second common node capacitively coupled to the voltage source and wherein each fluorescent light of the second plurality of fluorescent lights has a second terminal;

a third node commonly coupled to the second terminal of a first fluorescent light of the first plurality of fluorescent lights and to the second terminal of a first fluorescent light of the second plurality of fluorescent lights, the third node capacitively coupled to the voltage source; and a fourth node commonly coupled to the second terminal of a second fluorescent light of the first plurality of fluorescent lights and to the second terminal of a second fluorescent light of the second plurality of fluorescent lights but not to the third node, the fourth node capacitively coupled to the voltage source.

9. The fluorescent lighting system of claim 8 wherein the second common node is not connected to the first common node.

10. The fluorescent lighting system of claim 8 further including a first capacitor coupled between the third node and a terminal of the voltage source.

11. The fluorescent lighting system of claim 10 further including a second capacitor coupled between the fourth node and the terminal of the voltage source.

12. A method of forming a fluorescent lighting system comprising:

coupling a first terminal of each fluorescent light of a first plurality of fluorescent lights to receive a voltage from a voltage source through a first capacitor;

coupling a second terminal of a first fluorescent light of the first plurality of fluorescent lights to the voltage source through a second capacitor; and coupling a second terminal of a second fluorescent light of the first plurality of fluorescent lights to the voltage source through a third capacitor.

13. The method of claim 12 further including coupling a first terminal of each fluorescent light of a second plurality of fluorescent lights to receive the voltage through a fourth capacitor;

coupling a second terminal of a first fluorescent light of the second plurality of fluorescent lights to the voltage source through the second capacitor; and coupling a second terminal of a second fluorescent light of the second plurality of fluorescent lights to the voltage source through the third capacitor.

14. The method of claim 13 further including, coupling a first terminal of each fluorescent light of a third plurality of fluorescent lights to receive the voltage through a fifth capacitor;

coupling a second terminal of a first fluorescent light of the third plurality of fluorescent lights to the voltage source through the second capacitor;

coupling a second terminal of a second fluorescent light of the third plurality of fluorescent lights to the voltage source through the third capacitor; and coupling a second terminal of a third fluorescent light of the third plurality of fluorescent lights to the voltage source through a sixth capacitor.

* * * * *